United States Patent [19]

Del Bon

[11] 4,088,412

[45] May 9, 1978

[54] FOUNTAIN BRUSH

[76] Inventor: Luigi Del Bon, 141, Feldstrasse, Aarburg, Switzerland, CH-4663

[21] Appl. No.: 717,359

[22] Filed: Aug. 24, 1976

[51] Int. Cl.[2] ..... A46B 11/02

[52] U.S. Cl. ..... 401/151; 401/181

[58] Field of Search ..... 401/141-143, 401/146, 150-155, 162, 163, 170-182, 187, 188, 268-270, 278, 279

[56] References Cited

U.S. PATENT DOCUMENTS

| | | | |
|---|---|---|---|
| 841,946 | 1/1907 | Downing | 401/278 |
| 856,082 | 6/1907 | Moore | 401/153 |
| 1,787,896 | 1/1931 | Chamberlin | 401/153 |
| 1,918,069 | 7/1933 | Wallace | 401/182 |
| 2,997,078 | 8/1961 | Gainer | 401/175 |
| 3,827,813 | 8/1974 | Stryczek | 401/151 |

FOREIGN PATENT DOCUMENTS

| | | | |
|---|---|---|---|
| 24,019 of | 1911 | United Kingdom | 401/278 |

*Primary Examiner*—Robert W. Michell
*Assistant Examiner*—Jerome D. Stremcha
*Attorney, Agent, or Firm*—Gilbert L. Wells; Heinrich W. Herzfeld

[57] ABSTRACT

A fountain brush having a bristle carrier and a set of bristles thereon, a handle attached to the bristle carrier and forming a reservoir for a liquid or pasty medium, and an actuating device, attached to the end of the bristle carrier, remote from the bristles and comprising an actuating press-member, which is attachable to the inner wall of the handle via compressible bellows means is described. A channel is provided leading through the bristle carrier from the reservoir to an outlet orifice between the bristles, and an obturating member which either closes the orifice or clears it for the discharge of the medium therefrom. The obturating member is devised as a slide valve body guided in the interior of the channel and travels sealingly along the channel wall; the compressible bellows means is devised as a return spring member and is sealingly connected to the actuating press-member only after the medium has been filled into the reservoir; finally a connecting member, extending through the interior of the reservoir, is provided which rigidly connects the press-member and the slide valve body to one another and is of such length that, when the bellows means are relaxed, the slide valve body seals the outlet orifice, while it clears the orifice when the bellows means are compressed.

17 Claims, 6 Drawing Figures

FOUNTAIN BRUSH

BACKGROUND OF THE INVENTION

The present invention relates to a fountain brush having a bristle carrier and a set of bristles thereon, a handle attached to the bristle carrier and forming a reservoir for a liquid or pasty medium, and an actuating device, attached to the end of the bristle carrier remote from the bristles and comprising an actuating press-member, which is attachable to the inner wall of the handle via compressible bellows means, a channel leading through the bristle carrier from the reservoir to the bristles and having an outlet orifice between the bristles, and an obturating member which closes the said orifice or clears the latter for the discharge of the medium therefrom.

A fountain brush of this type has already been disclosed in British patent specification No. 913,371 to Ronald James Davenport, specifically for use as a toothbrush. However, the filling of the reservoir of this toothbrush which, in order to render the latter commercially competitive, must be carried out fully automatically, presents substantial problems. These arise because, on filling, the valve 24 at the outlet orifice must either be held closed by a gripper which can be applied externally, or must be designed to close so effectively that, on dispensing toothpaste or dental cleaning liquid from the reservoir, particularly if the latter is already partially empty, the bellows 11 must be compressed repeatedly in order to generate sufficient pressure in the interior of the reservoir to cause the valve, which closes very tightly, to release the outlet orifice.

Furthermore, the fitting of the outlet valve demands eccentric assembly of the components, and, as a result, complicated assembly machinery; furthermore, the cavity available within the handle is not fully available for accomodating the medium to be applied to the bristles.

Finally, the design of the channel in the bristle carrier, which has a capillary action on the medium flowing through it, is difficult to manufacture by modern mass production methods, especially by injection molding from thermoplastic material, because the thin core which would be required for such technique, would break off too easily.

OBJECTS AND GENERAL DESCRIPTION OF THE INVENTION

An object of the invention is to provide an improved fountain brush of the initially described type, which can be manufactured in a very simple manner by mass production techniques, whilst, moreover, the filling process can be carried out substantially more easily than for the known fountain toothbrush of the prior art. Another object is to provide a fountain brush of the initially described type, in which the cavity in the handle is fully utilized for accommodating the medium. At the same time, an object is to device the channel in the bristle carrier so it can be manufactured by injection molding without the danger of breaking off the required core, whilst the channel nevertheless can exert a capillary action on the medium flowing through it.

A further object of the invention is to provide a fountain brush of the initially described type, so metered amounts of the medium can be applied to the bristles.

These and further objects, which will emerge from the text of the description which follows, are achieved by a fountain brush of the type initially described, wherein the obturating member is devised as a slide valve body guided in the interior of the channel and travelling sealingly along the channel wall, the compressible bellows means is devised as a return spring member and is sealingly connected to the actuating press-member only after the medium has been filled into the reservoir, and a connecting member, extending through the interior of the reservoir, is provided which rigidly connects the press-member and the slide valve body to one another and is of such length that when the bellows means are relaxed the slide valve body seals the outlet orifice, whilst it clears the said orifice when the bellows means are compressed.

The slide valve body can be so designed that, whilst the bellows means and press-member are not yet connected, it seals the outlet orifice in a position such that there is an open gap between the rim of the free end of the bellows means and the pressure member, through which gap a medium can be filled into the reservoir. After the reservoir has been filled, during which process the outlet orifice thus continues closed, a leaktight joint between the press-member and the bellows means can be formed by ultrasonic welding, gluing or impact press-fit.

The channel can extend beyond the outlet orifice, sufficiently deeply into the end portion of the bristle carrier bearing the bristles, that the slide valve body can be accommodated in the end portion of the channel, while clearing the outlet orifice.

Preferably, the bellows means are made integrally with the wall of the reservoir. The press-member, connecting member and slide valve body are also preferably made as one piece.

Furthermore, the channel, in the region of its end portion comprising the outlet orifice, can be of cylindrical configuration whilst the slide valve body can be a piston of circular cross-section, and sealing means can be provided between the cylindrical wall of the channel and the cylindrical surface of the piston.

The connecting member can have a diameter so that between its outer wall and the inner wall of the channel there only remains an annular gap of such diameter that it exerts a capillary action on the medium, slowing down its discharge.

Furthermore, in its region adjoining the slide valve body the connecting member can carry a disc firmly seated thereon, the diameter of which disc is smaller than the diameter of the region of the inner wall of the reservoir toward which the disc is facing when the slide valve body is in the orifice-closing position.

At the same time, the reservoir can be so devised that, at least from the region of its inner wall which is facing the disc it tapers conically towards the channel, so that on actuating the press-member to cause opening of the discharge orifice, by the slide valve body freeing the orifice, the disc will seal against the conical region of the inner wall of the reservoir.

The wall of the handle which contains the reservoir is preferably of rigid construction at least starting from the bristle free end which carries the actuating device, and up to at least the zone at which the handle adjoins the bellows means, and a sleeve which has a rigid wall and is open at the end of the handle remote from the bristles can be provided around the bellows means.

Preferably, at least one lateral cut-out is provided in the sleeve, through which the bellows means can be reached. During the production of the joint between the outer rim of the bellows means and the press-member, a tool serving as tongs can be introduced through this lateral cut-out; this tool grips the fold of the bellows in the most outward position, remote from the bristles, and holds it during welding by ultrasonics, gluing or impact press-fit or other appropriate methods of bonding, whilst externally the press-member can be exposed to ultrasonic waves or can have pressure or other appropriate measures applied to it without thereby interfering with the medium already introduced into the reservoir. Furthermore, the finger which actuates the press-member can, passing through the cut-out, completely compress the bellows means, whilst, otherwise, the rigid sleeve protects the press member from unintentional actuation.

In another embodiment of the fountain brush, the side wall of the bellows means is provided with a helicoidally extending fold.

Correspondingly, the press-member, in the form of a closure cap, is provided with an internal thread which can be screwed onto the fold of the bellows means and which, when completely screwed thereonto, prevents compression of the latter and only permits compression of the bellows means and clearing of the outlet orifice by the slide valve body, when the cap is at least partially unscrewed from the bellows means.

The end portion of the channel in the bristle carrier preferably extends sufficiently far beyond the terminal actuating position of the slide valve body so that an air cushion is formed between the latter and the end wall of the channel when the slide valve body is pushed inwardly so as to free the outlet orifice.

The interior of the bellows means is advantageously a part of the reservoir in the handle, or is in free communication with the reservoir.

The bristle carrier, the channel therein, the handle which contains the reservoir, the bellows means and the actuating device comprising the press-member, slide valve body and connecting member thereof, are preferably arranged on a common longitudinal axis, which is a central axis for each of the parts mentioned.

Finally, a protective cap can be provided for the bristles which cap can be mounted on the bristle carrier, transversely to the said longitudinal axis.

BRIEF DESCRIPTION OF THE DRAWINGS

Further details of the fountain brush according to the invention are described in relation to the attached drawings. In these.

DETAILED DESCRIPTION OF PREFERRED EMBODIMENTS OF THE INVENTION

Figure 1:
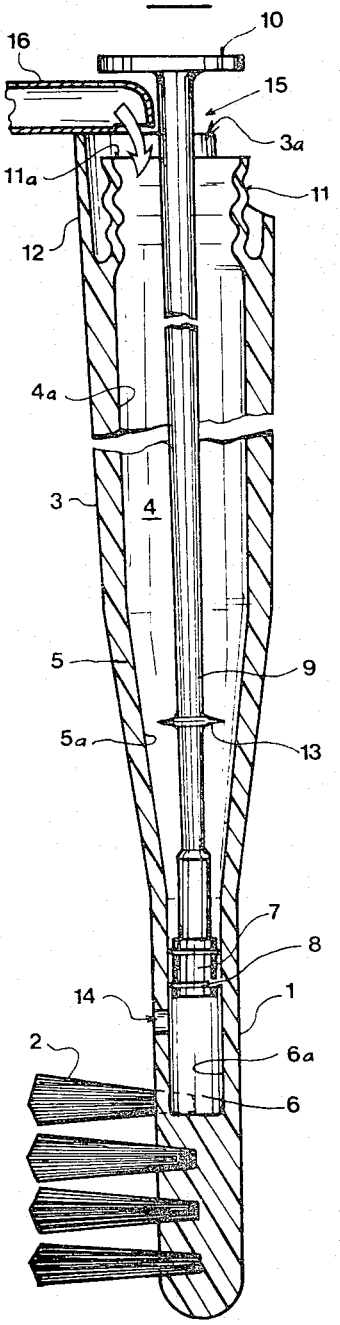
FIG. 1 shows, in interrupted longitudinal sectional view, a preferred embodiment of the fountain brush according to the invention, in which the parts are in the position necessary for filling a medium into the reservoir.
Figure 2:
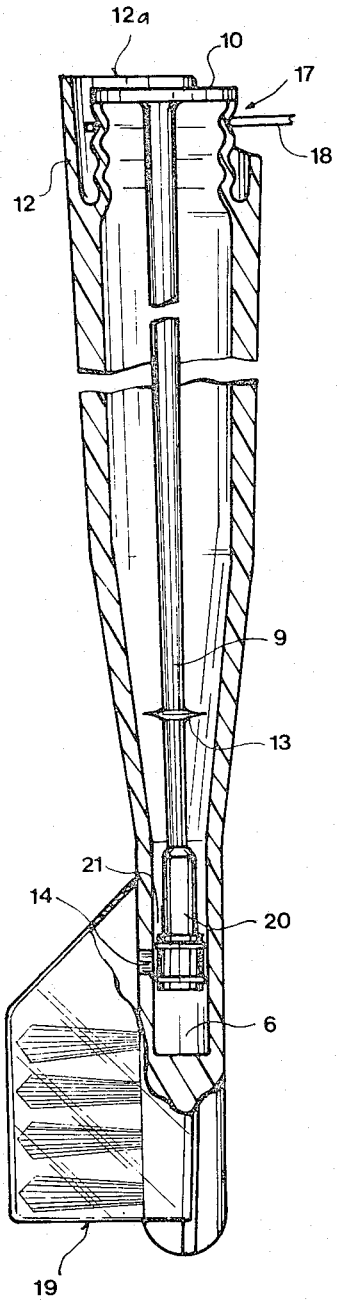
FIG. 2 shows the same longitudinal sectional view, but with the fountain brush in the closed position, after filling has been completed.
Figure 3:
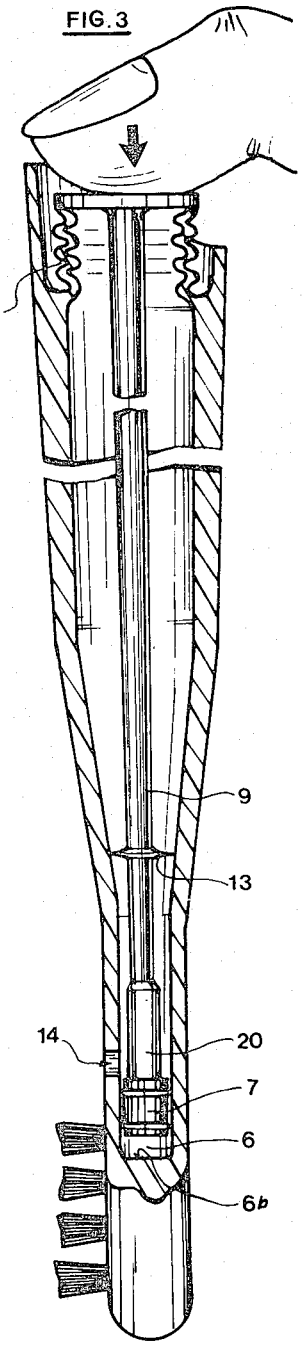
FIG. 3 shows the same longitudinal section, but with the fountain brush in the opened position for dispensing a medium onto the bristles.

In the embodiment shown in FIGS. 1 to 3, the fountain brush has a bristle carrier 1 provided, in the usual manner, with a set of bristles 2. The bristles can point in one direction, for example when the dispenser brush is to be used as a toothbrush or as an applicator brush for shoe polish, but they can also project from the bristle carrier radially to the longitudinal axis of the brush, in several or all directions. Finally, they can also be attached in the manner of a paint brush, at an angle to the bristle carrier, and project beyond the front end, or the lower end with respect to the drawing, of the bristle carrier.

The bristle carrier 1 is joined at the back, or upwardly with respect to the drawing, to the handle 3, which is preferably constructed integrally with the bristle carrier 1.

The hollow interior of the handle 3 serves as a reservoir 4, and is cylindrical in its middle and rear region, whilst in the direction toward the bristle carrier 1 it tapers conically in a transition region 5 and finally terminates in a channel 6, of constant cross-section, in the bristle carrier 1.

The slide valve body, built as a cylindrical piston 7, travels in the channel 6 and produces a hermetic seal against the channel wall by virtue of its sealing beads 8, which are preferably injection-molded onto the piston. From the piston 7, the connecting rod 9 extends backwards out of the open end 3*a* of the handle 3 and carries, at its outer end, the press-member which is constructed as a circular disc 10.

The periphery of the press-disc 10 is constructed to seal the open end 11*a* of compressible bellows 11 possessing several folds, the bellows being attached to the inner wall 4*a* of the handle surrounding the reservoir 4, and preferably being integral with the said handle; the bellows are surrounded by a rigid sleeve 12 forming the end portion, remote from the bristles, of the handle 3. The outer rim of the sleeve 12, which surrounds the open and 3*a* of the handle, projects sufficiently far beyond the upper rim 11*a* of the bellows 11 to protect the latter against unintentional compression. A disc 13 is mounted on the connecting rod 9, between the piston 7 and the press-disc 10, the diameter of the disc being such that in a given advanced position of the piston 7 in the channel 6, the rim of the disc 13 can rest against the inner wall 5*a* of the conical region 5 of the reservoir 4 (FIG. 3).

Filling and Sealing of the Fountain Brush

On filling a medium into the reservoir 4, the actuating unit, which comprises the piston 7, connecting rod 9 and press-disc 10, and which is preferably made of one piece, is first moved some distance outwards in the channel 6, so an outlet orifice 14, leading from the interior of the channel through the wall of the bristle carrier 1, is shut off leaktight from the reservoir 4 by the piston 7, whilst a sufficiently large gap 15 remains free between the disc 10 which represents the press-member and the upper rim 11*a* of the bellows 11, so that an injection nozzle 16 for liquid medium, resting on the upper rim of the sleeve 12, can be introduced into the gap 15.

The entire cavity of the reservoir can now be filled, through the nozzle 16, up to the upper rim 11*a* of the bellows 11.

In the case of automatic filling, the fountain brush is now moved away from the fixed nozzle 16 and thereafter the press-disc 10 is pressed to bring it to the non-actuated closed position shown in FIG. 2, in which it rests on the upper rim 11*a* of the bellows 11, whilst at the same time, if the length of the connecting rod 9 is correctly chosen, the piston 7 continues to seal the interior of the reservoir 4 hermetically from the outlet orifice 14. On pressing-in the actuating unit, the level of the medium in the reservoir 4 falls slightly so that a small air-filled space, extending up to the underside of the pressure member 10, remains in the interior of the bellows, above the level of the medium. This space is desirable since, in the position shown in FIG. 2, it is now possible to weld or glue the periphery of the disc 10 to the peripheral rim 11*a* of the bellows 11 without adversely affecting the medium.

In the sleeve 12 there is preferably, on the side of the actuating finger, a cut-out 17, through which a tong-like or fork-like instrument 18 can be introduced for engaging the uppermost fold of the bellows 11; this instrument firmly holds the bellows in the normal, relaxed position during production of a tight bond between the upper rim 11*a* of the bellows and the press-disc 10, and thus secures the bellows against unintentional compression. After closing the filled reservoir 4, as described, the instrument 18 is again removed and the fountain brush is now ready to use.

Use of the Fountain Brush

In order to use the fountain brush, which is in the non-actuated position shown in FIG. 2, for example to use it as a toothbrush or for applying shoe polish, a slight pressure is exerted on the press-disc 10 by means of one finger of the hand which holds the brush, and thereby, as shown in FIG. 3, the bellows 11 are compressed and the connecting rod 9, carrying the disc 13, is moved downwards, and the piston 7 is pushed beyond the outlet orifice 14 into the channel 6. This produces a free communication, permitting unhindered flow, between the interior of the reservoir 4 and the outlet orifice 14, with the disc 13 assisting in forcing the liquid into the conical region 5 of the reservoir 4, until its peripheral rim encounters the inner wall of the region 5, thereby restricting the amount of medium dispensed to a determined dose.

In the case of media of particularly low viscosity it can be desirable to exert a capillary action, preferably a braking action, at the inner wall of the channel 6 on the medium which flows to the outlet orifice 14. For this purpose the connecting rod 9 possesses, at its end connected to the piston 7, a cylindrical thickened portion 20 of such diameter as to leave, between the thickened portion and the inner wall 6*a* of the channel 6, a small annular gap 21, the cross-section of which exerts a greater or lesser capillary action on the medium, in accordance with the viscosity of the latter.

In the actuated position shown in FIG. 3, the piston 7 has left an air cushion under pressure in the end portion 6*b* of the channel 6; after lifting the finger off the press-disc 10, this air cushion can assist the return of the bellows 11, which now act as a return spring, to the relaxed position shown in FIG. 2.

Furthermore, when the piston 7 and bellows 11 are being returned to their starting position as shown in FIG. 2, air is briefly drawn in through the outlet orifice 14, to balance the pressure in the reservoir 4, until the piston 7 closes the outlet orifice 14.

Figure 4:
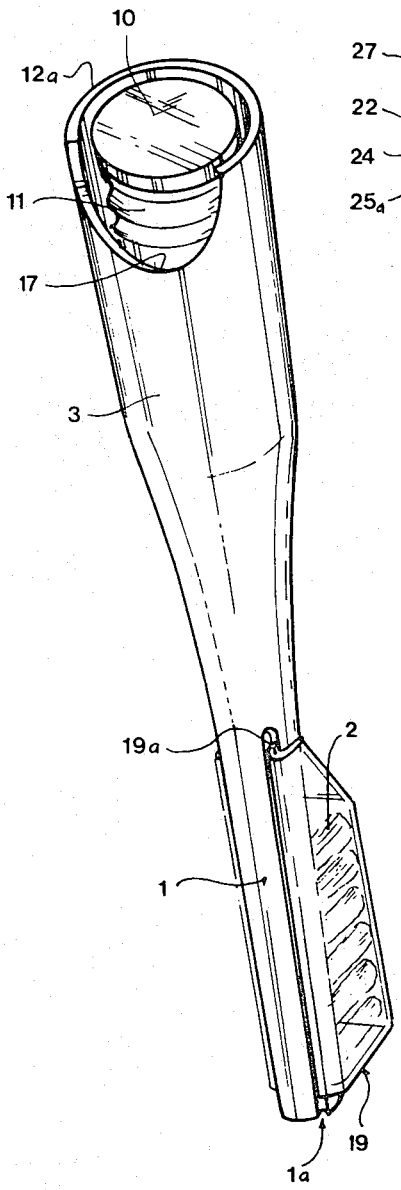
FIG. 4 shows a perspective view of the integral structure of the bristle carrier and handle, before introducing the actuating unit, but with the protective cap fitted onto the bristles.

In the perspective view, shown in FIG. 4, of the body of the fountain brush, consisting integrally of the bristle carrier 1 and the handle 3, in the embodiments of FIGS. 1 to 3, the actuating unit comprising the piston 7, connecting rod 9 and press-disc 10 has not yet been inserted. The set of bristles 2 is covered by a protective cap 19, which carries, at its lower open longitudinal edges, internal beads 19*a* which engage in corresponding longitudinal grooves 1*a* in the side wall of the bristle carrier 1, on either side of the set of bristles 2.

Figure 5:
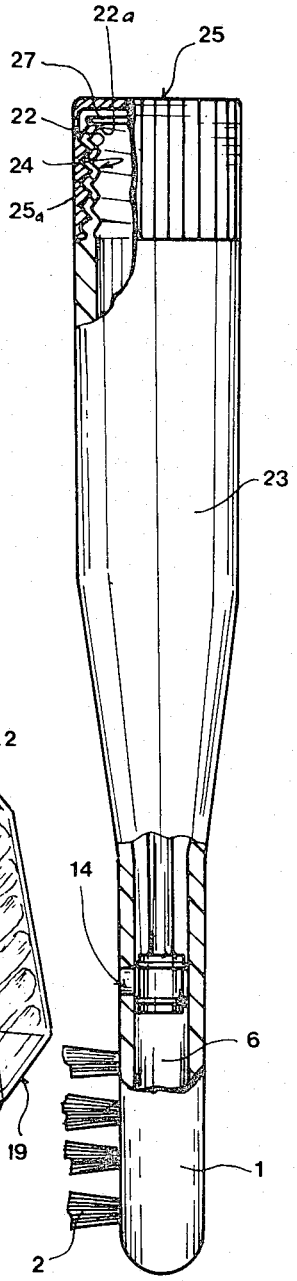
FIG. 5 shows a longitudinal sectional view of a further embodiment of the fountain brush in the closed position, secured against actuation.
Figure 6:
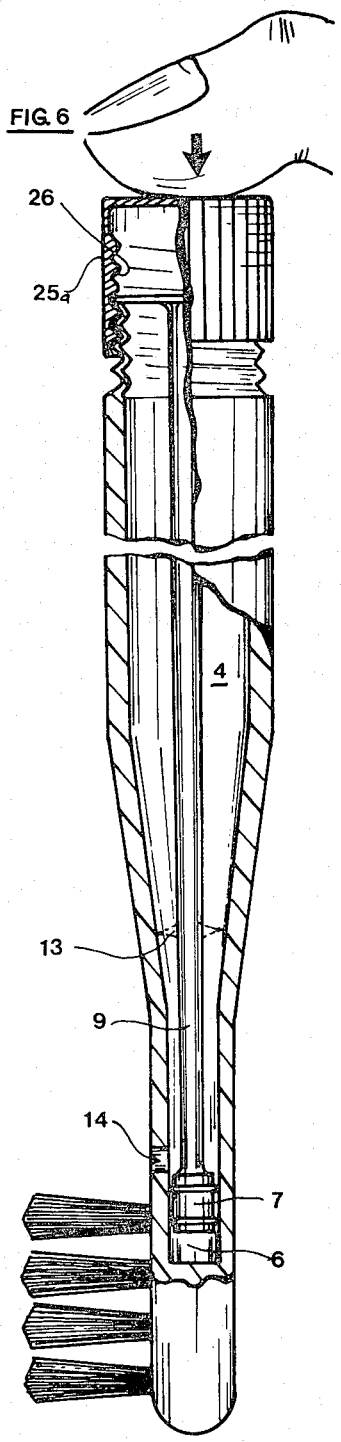
FIG. 6 shows a longitudinal sectional view of the same embodiment, in the actuated position.

In the embodiment shown in FIGS. 5 and 6, the bellows 22 are not surrounded by a rigid sleeve but form the rear (upper) end of the handle 23 and possess a helicoidal fold in the bellows wall. The bristle carrier 1, the channel 6 in the latter, the outlet orifice 14 and the set of bristles 2 are virtually identical with those of the first embodiment.

In order to prevent unintentional actuation of the second embodiment, shown in the rest position in FIG. 5, a securing and actuating cap 25 is screwed onto the outer thread formed by the fold 24 in the bellows 22, by means of the inner thread 26 which is provided on the side wall 25*a* of the cap 25 and fits the outer thread of the bellows, until all the turns of the fold 24 rest against corresponding turns of the inner thread 26. This prevents compression of the fold 24 of the bellows 22 when pressure is exerted axially on the cap 25.

If the cap 25 is unscrewed so that a part of the helidoidal fold 24 is exposed below the cap 25 and out of contact with the internal thread 26, this exposed region of the bellows 22 can be compressed if pressure is exerted on the upper face of the cap 25, and as a result the sealing disc 27, which, after the filling of the reservoir 4, has, also in the instant embodiment, been joined firmly and sealingly to the upper rim 22*a* of the bellows 22, and the connecting rod 9 bearing disc 27, and the piston 7, are moved downwards until the outlet orifice 14 is freed (FIG. 6).

The more the cap 25 is unscrewed from the fold 24 of the bellows 22, the more the bellows 22 can be compressed and the more the pressure on the surface of the medium in the interior of the reservoir 4 can be increased.

The fountain brush according to the invention can be used for a large variety of purposes, depending on the bristles of the brush and on the nature of the medium contained in the fountain brush; thus it can be used as a toothbrush or as an applicator brush for liquid or semi-liquid shoe care agents.

The fountain brush according to the invention can also be used for applying cosmetics, for tinting or dyeing hair or for applying hair cosmetics, but also for brushing oil onto not readily accessible surfaces of precision instruments, and for many other purposes.

The viscosity of the medium, for example of liquid dental preparations, can be kept within the known limits, but can also be substantially higher, since the disc 13 on the connecting rod 9 assists in expelling a medium of thicker consistency, whilst the piston 7 can come to rest just behind the outlet orifice 14 when the bellows 11 are fully compressed, so the piston can push medium, which may have remained in the channel 6, in front of it back into the reservoir 4 when the outlet orifice 14 is reclosed. As a result, only a small residual amount of medium remains in the outlet orifice 14 and this can easily be removed completely when rinsing the set of bristles after use. The undersirable blockage occurring in known fountain toothbrushes having a narrow channel leading to the outlet orifice and resulting from the residual amounts of medium remaining in the channel after use is difficult to wash out, but is completely avoided by the disperser brush according to the invention due to the capillary action between the channel wall and the medium. Hence, the use of the latter brush as a toothbrush is hygienically unobjectionable.

Fitting the slide valve body in the immediate vicinity of the outlet orifice also achieves particularly good protection against unintentional discharge of the medium if the temperature rises, and against pressure rise in the interior of the reservoir, resulting from such temperature rise. The sealing rings which surround the slide valve body and are preferably injection-molded onto it rest against the inner wall of the channel under sufficient friction and deformation to be able to compensate slight changes in cross-section due to temperature changes.

The body of the fountain brush according to the invention is preferably manufactured by injection molding from a thermoplastic material, preferably from a polyethylene having a density in the range of from 0.918 to 0.96 g/cm$^3$.

The manufacture of the fountain brush according to the invention is particularly facilitated and rendered inexpensive if all parts of its body are designed to be rotationally symmetrical about the longitudinal axis of the brush, which is the central axis of these parts of the body. This also applies to all cavities and recesses with the exception of the outlet orifice, and furthermore also applies to the actuating unit comprising the slide valve body, connecting rod and press-member.

The actuating unit can also be manufactured by injection molding, from a harder plastic material, preferably a polyethylene of higher specific gravity than mentioned above, or from polypropylene.

Using the above-mentioned material for the bellows, which are provided with a folded wall and are manufactured integrally with the bristle carrier and the handle, and which gives to the bellows an elastic springy nature resulting from the fold provided therein, will always allow the bellows to return to their relaxed starting position even if the bellows are repeatedly deformed by compression. The bellows can therefore at the same time serve as a return spring member for the entire actuating unit.

What is claimed is:

1. A fountain brush having a bristle carrier and a set of bristles thereon, a handle attached to the bristle carrier and forming a reservoir for a liquid or pasty medium, and an actuating device, attached to the end of the bristle carrier, remote from the bristles and comprising an actuating press member, which is attachable to the inner wall of the handle via compressible bellows means, a channel leading through the bristle carrier from the reservoir to the bristles and having an outlet orifice between the bristles, and an obturating member which closes the said orifice or clears the latter for the discharge of the medium therefrom, wherein the obturating member is devised as a slide valve body guided in the interior of the channel and traveling sealingly along the channel wall, the compressible bellows means is devised as a return spring member and is sealingly connected to the actuating press-member only after the medium has been filled into the reservoir, and a connecting member, extending through the interior of the reservoir, is provided which rigidly connects the press-member and the slide valve body to one another and is of such length that when the bellows means are relaxed the slide valve body seals the outlet orifice, whilst it clears the said orifice when the bellows means are compressed, wherein a part of the wall of the handle, starting from the bristle-free end which carries the actuating device and up to at least the zone at which the handle adjoins the bellows means, is rigid and comprises a sleeve portion which is open at the end of the handle remote from the bristles and is provided around the bellows means.

2. A fountain brush as described in claim 1, with the bellows means and press-member unconnected wherein the length of the channel between the outlet orifice and the reservoir is sufficiently long so the slide valve body can prevent medium from flowing through the outlet orifice while providing an open gap between the rim of the free end of the bellows means and the pressure member, through which gap a medium can be filled into the reservoir.

3. A fountain brush as described in claim 1, wherein said channel extends beyond the outlet orifice, sufficiently deeply into the end portion of the bristle carrier bearing the bristles, so that the slide valve body can be accommodated in the end portion of the channel while clearing the outlet orifice.

4. A fountain brush as described in claim 3, wherein the bellows means are made integrally with the wall of the reservoir.

5. A fountain brush as described in claim 3, wherein the actuating press-member, connecting member and slide valve body are integral with one another.

6. A fountain brush as described in claim 1, wherein the channel, in the region of its end portion comprising the outlet orifice, is of cylindrical configuration whilst the slide valve body is a piston of circular cross-section, and sealing means are provided between the cylindrical wall of the channel and the cylindrical surface of the piston.

7. A fountain brush as described in claim 1, wherein the diameter of the connecting member is such that between its outer wall and the inner wall of the channel there only remains an annular gap of such diameter that it exerts a capillary action on the medium, slowing down its discharge.

8. A fountain brush as described in claim 3, wherein the connecting member carries in its region adjoining the slide valve body a disc firmly seated thereon, the diameter of which disc is smaller than the diameter of the region of the inner wall of the reservoir toward which the disc is facing when the slide valve body is in the orifice-closing position.

9. A fountain brush as described in claim 8, wherein the reservoir is so deviced that, at least from the region of its inner wall which is facing the disc it tapers conically towards the channel, in such a way that on actuating the press-member to cause opening of the discharge orifice by the slide valve body freeing the orifice, the disc sealingly engages the conical region of the inner wall of the reservoir.

10. A fountain brush as described in claim 1, wherein at least one lateral cut-out is provided in the sleeve, through which the bellows means can be reached.

11. A fountain brush as described in claim 1, wherein the side wall of the bellows means is provided with a helicoidally extending fold.

12. A fountain brush as described in claim 11, wherein the press-member is in the form of a cap being provided with an internal thread which can be screwed onto the fold of the bellows means and which, when completely screwed thereonto, prevents compression of the latter and only permits compression of the bellows means and clearing of the outlet orifice by the slide valve body, when the cap is at least partially unscrewed from the bellows means.

13. A fountain brush as described in claim 1, wherein the end portion of the channel in the bristle carrier extends sufficiently far beyond the terminal actuating position of the slide valve body so that an air cushion is formed between the latter and the end wall of the channel when the slide valve body is pushed inwardly so as to free the outlet orifice.

14. A fountain brush as described in claim 1, wherein the interior of the bellows means is a part of the reservoir in the handle, or is in free communication with the reservoir.

15. A fountain brush as described in claim 1, wherein the bristle carrier, the channel therein, the handle which contains the reservoir, the bellows means and the actuating device comprising the press-member, slide valve body and connecting member thereof, are arranged on a common longitudinal axis, which is a central axis for each of the parts mentioned.

16. A fountain brush as described in claim 15, wherein a protective cap is provided for the bristles which cap can be mounted on the bristle carrier, transversely to the said longitudinal axis.

17. A fountain brush having:

(a) a bristle carrier and, at one end of the latter, a set of bristles thereon;

(b) a handle attached to the other end of the bristle carrier and having a reservoir for a liquid or pasty medium in its interior, the end of said handle away from said bristles being open;

(c) a channel extending axially through the bristle carrier from the reservoir into the end of said carrier bearing the bristles and having at least one radial outlet orifice in the sidewall of said carrier, and ending blind in the bristles-bearing carrier end at a distance from said orifice;

(d) a slide valve member guided sealingly in the interior of said channel;

(e) an actuating device, attached to the end of the handle, remote from the bristles and comprising a closure member adapted for hermetically closing said reservoir having medium therein;

(f) a connecting rod, extending substantially axially through the interior of the reservoir, which connecting rod connects the actuating device and the slide valve member to one another and is of such length that when the actuating device is unactuated the slide valve member seals the outlet orifice whilst it clears the said orifice when said actuating device is actuated, said connecting rod being rigidly resistant to pressure thereon in axial direction, said closing member being at such distance from said slide valve member that, in a filling position in which medium can be filled into said reservoir, said closing member leaves the open end of said handle free while said slide valve member seals off said reservoir in a position in said channel more remote from the blind end of the channel than said orifice; and (g) an elastically deformable bellows being connected hermetically sealingly with said closing member and the inner wall of said handle in actuated as well as in unactuated position of said actuating device, thereby closing said reservoir, whereby said slide valve member obturates said orifice when in the said unactuated position and whereby, upon actuation by pressure on said closing-member, said slide valve member is moved into said blind end of said channel past said orifice clearing the latter.

* * * * *